US009340975B2

(12) United States Patent
Liu

(10) Patent No.: US 9,340,975 B2
(45) Date of Patent: May 17, 2016

(54) METHOD OF CASTING IN-SITU FERROCEMENT RIBBED SLAB WITH SPLICED RACK AND SUSPENDED FORMWORK

(75) Inventor: Chun Liu, Jinan (CN)

(73) Assignee: Kunshan Ecological Building Technology Co., Ltd., Jiangsu (CN)

( * ) Notice: Subject to any disclaimer, the term of this patent is extended or adjusted under 35 U.S.C. 154(b) by 0 days.

(21) Appl. No.: 14/399,921

(22) PCT Filed: May 8, 2012

(86) PCT No.: PCT/CN2012/075190

§ 371 (c)(1),
(2), (4) Date: Nov. 7, 2014

(87) PCT Pub. No.: WO2013/166658

PCT Pub. Date: Nov. 14, 2013

(65) Prior Publication Data

US 2015/0145156 A1 May 28, 2015

(51) Int. Cl.
*E04C 5/00* (2006.01)
*E04C 5/06* (2006.01)
(Continued)

(52) U.S. Cl.
CPC ... *E04B 5/38* (2013.01); *E04B 5/36* (2013.01); *E04C 3/08* (2013.01); *E04C 5/00* (2013.01);
(Continued)

(58) Field of Classification Search
CPC ..... E04C 5/00; E04C 5/0636; E04C 5/064; E04C 3/08
USPC ..... 264/333; 52/664
See application file for complete search history.

(56) References Cited

U.S. PATENT DOCUMENTS 2,112,949 A * 4/1938 Bunker ..... E01D 19/125 52/318
3,283,466 A * 11/1966 Grebner ..... E04C 5/065 52/340

(Continued)

FOREIGN PATENT DOCUMENTS

CN 1275667 A 12/2000
CN 1904280 A 1/2007

(Continued)

OTHER PUBLICATIONS

International Search Report dated Feb. 7, 2013 from International Patent Application No. PCT/CN2012/075190 filed May 8, 2012.

*Primary Examiner* — Christina Johnson
*Assistant Examiner* — Patrick Butler
(74) *Attorney, Agent, or Firm* — Sunstone IP

(57) ABSTRACT

Disclosed is a method of casting in-situ a ferrocement ribbed slab with a spliced rack and a suspended formwork. The method comprises the following specific steps: step 1: machining at a plant a transverse plane truss girder, an incomplete longitudinal plane truss girder and an incomplete longitudinal plane truss; step 2: making a bottom formwork; step 3: splicing and constructing an on-site truss in a grid shape; step 4: suspending the bottom formwork; step 5: laying reinforcing mesh pieces; and step 6: performing in-situ casting. In the present method of casting in-situ a ferrocement ribbed slab with a spliced rack and a suspended formwork, the interspaced rack becomes a spliced rack and is applied to in-situ casting of floor slabs, such that a ferrocement ribbed slab is directly cast on site, and is cast as one with beams and columns, enabling the range of use of ferrocement ribbed slabs to be extended to the floor slabs of various buildings.

10 Claims, 2 Drawing Sheets

(51) Int. Cl.

| | |
|---|---|
| ***E04C 3/08*** | (2006.01) |
| ***E04B 5/38*** | (2006.01) |
| ***E04G 11/38*** | (2006.01) |
| ***E04B 5/36*** | (2006.01) |
| ***E04G 21/12*** | (2006.01) |
| *E04C 3/04* | (2006.01) |

(52) U.S. Cl.
CPC ..... *E04C 5/064* (2013.01); *E04C 5/0636* (2013.01); *E04G 11/38* (2013.01); *E04G 21/12* (2013.01); *E04C 2003/0491* (2013.01)

(56) References Cited

U.S. PATENT DOCUMENTS

| | | | | |
|---|---|---|---|---|
| 3,336,718 | A * | 8/1967 | Cape | E04B 1/19 52/650.3 |
| 3,641,303 | A * | 2/1972 | Collins | B23K 11/008 219/56 |
| 6,244,008 | B1 * | 6/2001 | Miller | E04B 5/04 52/309.12 |
| 6,973,864 | B1 * | 12/2005 | Ahmad | E04H 9/10 52/454 |
| 2005/0235590 | A1 | 10/2005 | Pace | |
| 2007/0079570 | A1 * | 4/2007 | Sorial | E04B 5/36 52/337 |

FOREIGN PATENT DOCUMENTS

| | | | |
|---|---|---|---|
| CN | 201217872 | Y | 4/2009 |
| CN | 102409848 | A | 4/2012 |
| CN | 102425306 | A | 4/2012 |
| CN | 102635235 | A | 8/2012 |
| CN | 202530614 | U | 11/2012 |
| JP | 2000248678 | A | 9/2000 |

* cited by examiner

METHOD OF CASTING IN-SITU FERROCEMENT RIBBED SLAB WITH SPLICED RACK AND SUSPENDED FORMWORK

TECHNICAL FIELD

The present invention relates to a construction technology of a ferrocement ribbed slab for building, and more particularly, to a method of casting in-situ a ferrocement ribbed slab through a spliced rack and a suspended formwork.

BACKGROUND

A Ferrocement ribbed slab given in the Chinese standard No. GB/T 16308-2008 is a kind of precast floor slab, which has advantages of light weight and less material consumption, has an average thickness of merely about 3 cm and hence may reduce 70% of materials compared with the ordinary in-situ cast floor slab, thus it is worth popularizing the ferrocement ribbed slab as a structured floor slab. If the ferrocement ribbed slabs are employed as floor slabs in all buildings under construction, the concrete to be saved every year would be stacked into a hill. However, the ferrocement ribbed slab needs to be precast and is difficult to transport because of its larger size. Further, due to the connection problem between the ferrocement ribbed slab and beam columns, which has a great influence on the rigidity of the whole floor slab in the building, the ferrocement ribbed slabs are not utilized widely. Moreover, due to the limitation of the existing on-site production technology level, the existing construction technology cannot meet the requirement of casting in-situ the ferrocement ribbed slab.

SUMMARY

In view of the defects existing in the prior art, an object of the present invention is to provide a method of casting in-situ a ferrocement ribbed slab with a spliced rack and a suspended formwork, such that the ferrocement ribbed slab can be formed integrally with a beam column through casting in situ, thus the ferrocement ribbed slab can be widely applied to a variety of building floor slabs.

In order to achieve the above object, the present invention proposes the following technical solution:

A method of casting in-situ ferrocement ribbed slab through a spliced rack and a suspended formwork, comprising steps of:

Step 1) of prefabricating a transverse plane truss girder 1, an incomplete longitudinal plane truss girder 2 and an incomplete longitudinal plane truss 3 in a factory, wherein the transverse plane truss girder 1, the incomplete longitudinal plane truss girder 2 and the incomplete longitudinal plane truss 3 are configured to be spliced to a mesh truss 4 in constructing in-situ.

A width D and a height H of the mesh truss 4 are selected according to span and load bearing requirements of a floor slab, and then fabricating the transverse plane truss girder 1 with the height H, the incomplete longitudinal plane truss girder 2 with the height H and the incomplete longitudinal plane truss 3 with the height H by using an automatic truss welding machine, where the length of the transverse plane truss girder 1 is equal to the width D.

Step 2) of making a bottom formwork:

The bottom formwork is made of light material with a good fire resistant and soundproof performance, and is reinforced for a large construction load by increasing the strength of the bottom formwork or adding a steel mesh within the bottom formwork considering requirements of the construction load.

Step 3) of splicing and constructing a mesh truss 4 on site:

Wherein, the transverse plane truss girders 1 are placed in position according to the spacing requirements of the mesh truss and fixedly connected with a beam or a wall, thereby maintaining the transverse plane truss girder 1 horizontal;

Subsequently the incomplete longitudinal plane truss girders 2 are fixed on each of the transverse plane truss girders 1 perpendicularly to the transverse plane truss girders and connected to the beam or wall, wherein the spacing between the adjacent incomplete longitudinal plane truss girders 2 are conform to the spacing requirements of a mesh truss;

Then the incomplete longitudinal plane trusses 3 are arranged below and spliced with the incomplete longitudinal plane truss girders 2;

Lastly, the transverse plane truss girder 1, the incomplete longitudinal plane truss girders 2 and the incomplete longitudinal plane trusses 3 are fixedly connecting at intersections therebetween.

Step 4) of suspending the bottom formworks:

Wherein the bottom formworks are suspended and installed below the mesh truss 4 through connectors, and a gap between the bottom formworks is filled, and the spacing between the bottom formworks meets the sectional requirement of the ferrocement ribbed slab.

Step 5) of laying reinforcing mesh pieces:

Wherein the reinforcing mesh pieces are laid on both sides of the floor slab and the rib according to the structure requirements of the ferrocement ribbed slab, and then it is checked whether the structure requirements are met according to a blueprint.

Step 6) of performing in-situ casting:

Wherein self-leveling mortar, self-compacting mortar or self-compacting concrete is poured in-situ into the mesh truss 4 enclosed by the bottom formwork and the reinforcing mesh, to integrally connect the reinforcing mesh, the bottom formwork and the mesh truss 4 together, i.e., finish the in-situ construction of the in-situ ferrocement ribbed slab.

Based on the above technical solution, the transverse plane truss girder 1 includes an upper horizontal rod 11 for transverse plane truss girder and a lower horizontal rod 12 for transverse plane truss girder, a plurality of web rods 13 for transverse plane truss girder are connected between the upper horizontal rod 11 for transverse plane truss girder and the lower horizontal rod 12 for transverse plane truss girder, so that every two web rods 13 for transverse plane truss girder form a pair spliced into a triangular structure, wherein the adjacent triangular structures abut against each other.

Based on the above technical solution, the incomplete longitudinal plane truss girder 2 includes an upper horizontal rod 21 for incomplete longitudinal plane truss girder and a plurality of web rods 22 for incomplete longitudinal plane truss girder arranged below the upper horizontal rod 21 for incomplete longitudinal plane truss girder, wherein every two web rods 22 for incomplete longitudinal plane truss girder from a pair spliced into an inverted triangle structure, and the adjacent inverted triangle structures are spaced by a span of the inverted triangle structure.

Based on the above technical solution, the incomplete longitudinal plane truss 3 includes a lower horizontal rod 31 for incomplete longitudinal plane truss and a plurality of web rods 32 for incomplete longitudinal plane truss, wherein every two of the web rods 32 for incomplete longitudinal plane truss web form a pair spliced into a triangle structure, and the adjacent triangle structures are spaced by a span of the triangle structure.

Based on the above technical solution, the light material with a good fire resistant and sound proof performance which is used to make the bottom formwork is foam concrete.

Based on the above technical solution, the connector used in step 4) is embedded in advance within the bottom formwork.

The method of casting in-situ a ferrocement ribbed slab with a spliced rack and a suspended formwork has the following advantages:

1. The transverse plane truss girder 1, the incomplete longitudinal plane truss girder 2 and the incomplete longitudinal plane truss 3 can be prefabricated in the factory.

2. The transverse plane truss girder 1, the incomplete longitudinal plane truss girder 2 and the incomplete longitudinal plane truss 3 can form the mesh truss 4.

3. The bottom formwork is a disposable lightweight dedicated formwork, can meet the requirement for bearing the construction load and be used to form the section of the ferrocement ribbed slab, further the bottom formwork has heat insulating, fire-resistant and soundproof functions. Thus, the bottom formwork is a multi-purpose module meeting both the construction requirement and the operating requirement.

4. The connector can be embedded in advance within the bottom formwork, so that the bottom formwork can be easily connected with the mesh truss 4 through the connector; further, the bottom formwork may be threadedly fixed to the mesh truss 4, thereby ensuring the construction accuracy.

5. The mesh truss is fixed initially to ensure the correct relative position of the rebar inside the floor slab, which solves the problem that the accuracy of the relative position of the rebar in the existing construction technology cannot meet the requirement for the position accuracy of the rebar needed by the ferrocement ribbed slab.

6. For the splicing type mesh truss 4, a monolithic truss can be machined in the factory, such that the vertical flatness and rigidity of the beam can be well ensured and the end support of the beam is employed during the construction (the fixed connection of the mesh 4 and the beam or well includes the support), which solves the problems that the support is uneven in the existing construction technology.

7. The use of the bottom formwork which does not need to be removed (i.e. a disposable bottom formwork) avoids the problems that the formwork needs to be removed in the existing construction technology.

8. Because the bottom formwork is produced with reference to the relative position of the rebar, the relative position between the bottom formworks and between the bottom formwork and the rebar can be ensured, thus the accuracy of the formwork for casting in-situ the ferrocement ribbed slab can reach the production accuracy of the prefabricated formwork, thereby implementing the casting in-situ of the ferrocement ribbed slab.

9. The bottom formwork has soundproof performance, and can form a composite formwork together with the in-situ cast ferrocement ribbed slab, so the composite formwork has both a light weight performance and a good soundproof performance.

10. The bottom formwork has a better heat insulation effect, which can avoid the high temperature damage to the structure in the case of a fire emergency, thereby improving the fire-resistant performance.

11. The fixed connection between the bottom formwork and the mesh truss is implemented using the connector, and is formed integrally with the cast ferrocement ribbed slab, thus avoiding the release of the bottom formwork in subsequent use.

12. Because of the use of the suspended bottom formwork and the truss, the self-leveling mortar or the self-compacting concrete is applied directly to the rebar through the bottom formwork during the construction of the floor slab, and the support does not exist, so that the floor slab will not crack under the pulling stress produced by its self-weight, and the bottom formwork and the pouring material can combine together under their self-weight, thus the time for air and oxygen to come into contact with the rebar is prolonged, that is, the service time of the floor slab is increased indirectly.

BRIEF DESCRIPTION OF THE DRAWINGS

The accompanying drawings of the present invention are as follows.

DETAILED DESCRIPTION OF THE EMBODIMENTS

Figure 1:
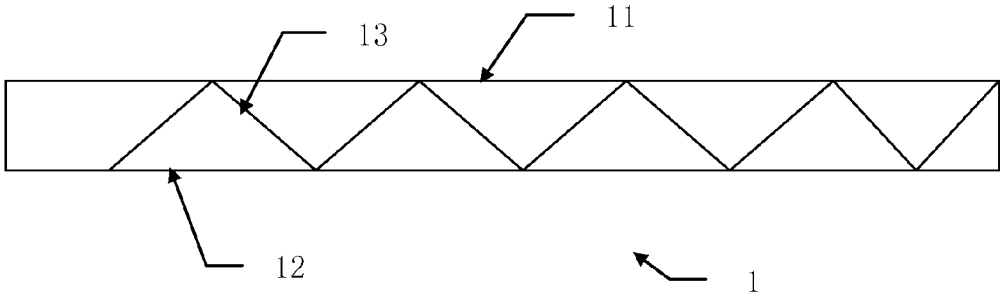
FIG. 1 is a schematic view of a transverse plane truss girder.

The invention will be further described in detail with reference to the accompanying drawings.

Due to significant differences between the prefabricated production technology and the in-situ production technology, analysis shows that the in-situ production of the ferrocement ribbed slab given in the Chinese standard No. GB/T 16308-2008 is mainly limited by the following technical bottlenecks:

1. Formwork Manufacture

The ferrocement ribbed slab given in the Chinese standard No. GB/T 16308-2008 is very demanding for the formwork due to its small cross section, and particularly requires for accuracy of the formwork that is much higher than that of an in-situ produced formwork. In the prefabrication of the ferrocement ribbed slab in the factory, steel molds and a steam curing method are employed to improve a turnover rate of the formwork, which cannot be achieved in field production, or achieved at a cost much higher than the cost of the formwork per se. Thus it is unworthy popularizing the in-situ production of the formwork.

2. The Removal of the Formwork

The removal of the formwork is a big problem in the conventional construction of an in-situ cast ferroconcrete ribbed floor slab, and such problem will be more serious for the ferrocement ribbed slab, because the traditional removal method using a crowbar for example is unsuitable for the ferrocement ribbed slab due to the thin rib of the ferrocement ribbed slab. Thus, a mold release agent is used for the removal of the formwork as regulated in the Chinese standard No. GB/T 16308-2008. However, it is difficult to surely prevent the mold release agent from polluting the rebar during the in-situ construction. Once the mold release agent pollutes the rebar, the bearing capacity of the formwork is degraded directly.

3. Support

The conventional construction technology of the in-situ cast ferroconcrete ribbed floor slab generally includes: firstly installing a support, then placing a laminated wood board, binding the rebar, and lastly pouring the concrete. But this construction technology has a problem in that the horizontal accuracy of the bottom formwork is low and formwork shifting, local dent or protrusion in the ferroconcrete ribbed floor may occur, which is fatal for the ferrocement ribbed slab and affects the sectional height of the ferrocement ribbed slab directly, that is, leading to the uneven bearing capacity of the formwork.

4. Rebar Fixation

To cast in-situ a ferroconcrete ribbed floor slab, generally the rebar is manually bound on the formwork, thus it is hard to ensure a constant relative space between rebars. However, very strict requirements are applied for the relative positions of rebars in the ferrocement ribbed slab due to the small section of the ferrocement ribbed slab. Therefore, the traditional construction technology cannot meet the requirements.

In addition to the above technical problems caused by the in-situ production, there also exist the following problems in usage and functions of the ferrocement ribbed slab which block the popularization of the ferrocement ribbed slab given in the Chinese standard No. GB/T 16308-2008:

1. The ferrocement ribbed slab is very thin, and hence has an unsatisfying soundproof effect, which cannot meet the use requirements of the soundproof effect as regulated in national specifications.

2. Fire resistant performance is bad due to that the cross section of the ferrocement ribbed slab is too thin so that the heat insulation performance of the ferrocement ribbed slab is poor.

A serial of improvements must be made to promote and popularize the ferrocement ribbed slab.

Space grids (also referring to as space truss, or three-dimensional truss, or space steel truss) are largely applied to a long-span roof structure, such as ceilings of many gas stations and gyms, but not to an in-situ cast ferroconcrete structure for the reason as follows:

1. The space grid is manufactured and installed as a whole, and hence is difficult to be combined with beam columns in a multi-story building, and is unsuitable for a small-span roof.

2. The space grid has very good rigidity and a high bearing capacity, thus it is unnecessary to attach concrete to the space grid since the concrete also adds weight. As such, it is a waste of resources to embed the space grid into the concrete, because such embedding cannot improve the bearing capacity, but add the weight, thereby degrading the load grade of the space grid.

3. The space grid, especially its nodes (e.g. spherical nodes), has high manufacture requirements, to overcome the problem of stress concentration.

Therefore, the space grid, as a load bearing structure, is used individually around the world.

This invention novelly changes the space grid into a spliced rack, which is applicable to the in-situ cast floor slab without the above-mentioned waste but saving a large number of formwork supports, to implement the incorporation and application of the prefabricated ferrocement ribbed slab technology into various in-situ cast floor slabs.

Figure 2:
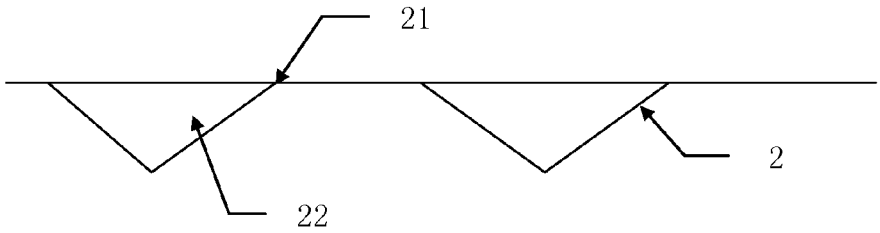
FIG. 2 is a schematic view of an incomplete longitudinal plane truss girder.
Figure 3:
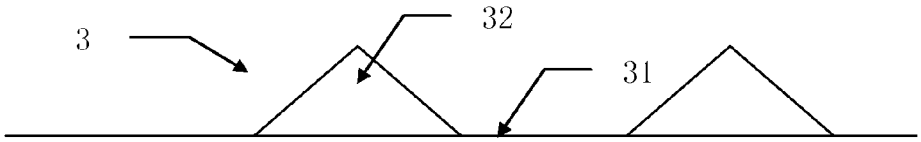
FIG. 3 is a schematic view of an incomplete longitudinal plane truss.
Figure 4:
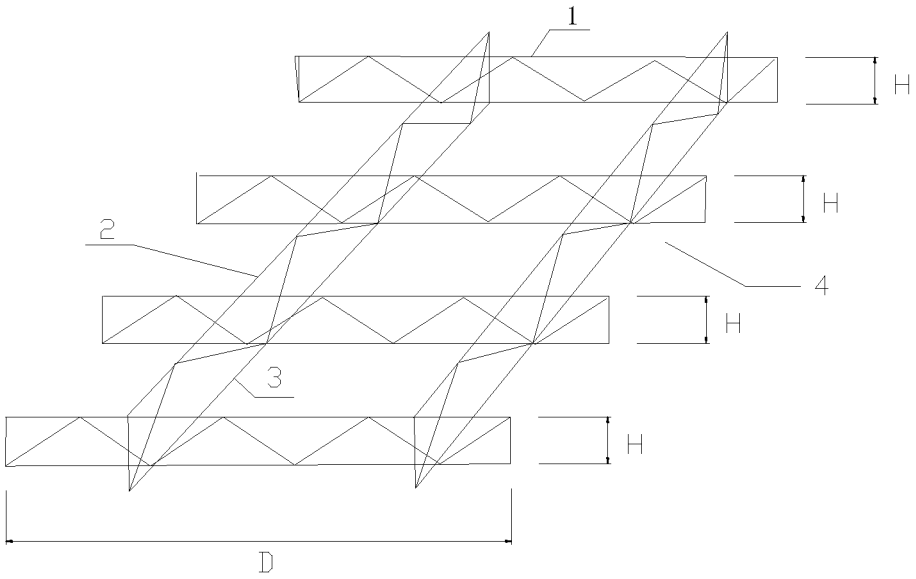
FIG. 4 is a schematic view of a spliced mesh truss.

A method of casing in-situ a ferrocement ribbed slab through a spliced rack and a suspended formwork according to the present invention, as shown in FIGS. 1 to 4, includes the following steps:

Step 1): prefabricating a transverse plane truss girder 1, an incomplete longitudinal plane truss girder 2 and an incomplete longitudinal plane truss 3 in a factory, where the transverse plane truss girder 1, the incomplete longitudinal plane truss girder 2 and the incomplete longitudinal plane truss 3 are configured to be spliced to a mesh truss 4 in constructing in-situ.

The width D and height H (see FIG. 4) of the mesh truss 4 are selected according to span and load bearing requirements of the floor slab, and the length of the mesh truss 4 can be selected as actually desired. The mesh truss 4 may have a square shape with a height H and a side length of D.

Then, a transverse plane truss girder 1 with a height H, an incomplete longitudinal plane truss girder 2 with the height H and an incomplete longitudinal plane truss 3 with the height H are fabricated by using an automatic truss welding machine, where the length of the transverse plane truss girder 1 is D.

The transverse plane truss girder 1 includes an upper horizontal rod 11 for transverse plane truss girder and a lower horizontal rod 12 for transverse plane truss girder, a plurality of web rods 13 for transverse plane truss girder are connected between the upper horizontal rod 11 for transverse plane truss girder and the lower horizontal rod 12 for transverse plane truss girder, so that every two of the web rods 13 for transverse plane truss girder form a pair spliced into a triangular structure, where adjacent triangular structures abut against each other.

The incomplete longitudinal plane truss girder 2 includes an upper horizontal rod 21 for incomplete longitudinal plane truss girder and a plurality of web rods 22 for incomplete longitudinal plane truss girder arranged below the upper horizontal rod 21 for incomplete longitudinal plane truss girder, where every two of the web rods 22 for incomplete longitudinal plane truss girder form a pair spliced into an inverted triangle structure, and the adjacent inverted triangle structures are spaced by a span of one inverted triangle structure.

The incomplete longitudinal plane truss 3 includes a lower horizontal rod 31 for incomplete longitudinal plane truss and a plurality of web rods 32 for incomplete longitudinal plane truss arranged on the lower horizontal rod 31 for incomplete longitudinal plane truss, where every two of the web rods 32 for incomplete longitudinal plane truss form a pair spliced into a triangle structure, and the adjacent triangle structures are spaced by a span of one triangle structure.

The span of the triangle structure formed with two web rods 32 for incomplete longitudinal plane truss is identical to the span of the inverted triangle structure formed with two web rods 22 for incomplete longitudinal plane truss girder.

The upper and lower horizontal rods are preferably made of twisted steel, and the web rod is preferably made of hot-rolled round steel.

Step 2): making a bottom formwork.

The bottom formwork may be made of light material with a good fire resistant and soundproof performance. Considering the requirements of the construction load, the bottom formwork should be reinforced for a large construction load by increasing the strength of the bottom formwork or adding a steel mesh within the bottom formwork.

The light material with a good fire resistant and soundproof performance which is used to make the bottom formwork may be foam concrete, which is of a low cost and thus is very advantageous for wide application.

Step 3): splicing and constructing a mesh truss 4 on site.

The transverse plane truss girders 1 are placed in position according to the spacing requirements of the mesh truss and fixedly connected with a beam or a wall (by a connection way which varies with a different beam or wall but may be implemented based on the prior art, which will not be repeated here), thereby maintaining the transverse plane truss girders 1 horizontal.

Subsequently the incomplete longitudinal plane truss girders 2 are fixed on each of the transverse plane truss girders 1 perpendicularly to the transverse plane truss girders 1, and connected to the beam or wall, where the spacing between the adjacent incomplete longitudinal plane truss girders 2 is conform to the spacing requirements of the mesh truss.

Then the incomplete longitudinal plane trusses 3 are arranged below and spliced with the incomplete longitudinal plane truss girders 2.

Finally, the transverse plane truss girder 1, the incomplete longitudinal plane truss girders 2 and the incomplete longitudinal plane trusses 3 are fixedly connected at intersections therebetween.

Step 4): suspending the bottom formworks:

The bottom formworks are suspended and installed below the mesh truss 4 through connectors, and a gap between the bottom formworks is filled, where the spacing between the bottom formworks meets the sectional requirement of the ferrocement ribbed slab.

The connector may be embedded in advance within the bottom formwork.

Step 5): laying reinforcing mesh pieces:

Reinforcing mesh pieces are laid on both sides of the floor slab and the rib according to the structure requirements of the ferrocement ribbed slab, and then it is checked whether the structure requirement are met according to the blueprint.

Step 6): performing in-situ casting:

Self-levelling mortar, self-compacting mortar or self-compacting concrete is poured in-situ into the mesh truss 4 enclosed by the bottom formwork and the reinforcing mesh, to integrally connect the reinforcing mesh, the bottom formwork and the mesh truss 4 together, i.e., finish the in-situ construction of the in-situ cast ferrocement ribbed slab.

With the in-situ cast ferrocement ribbed slab fabricated with the spliced rack and the suspended formwork through the cast-in-situ construction technology, features of the light weight and less material of the prefabricated ferrocement ribbed slab are maintained, defects of bad soundproof and poor fire-resistant performance of the ferrocement ribbed slab are overcome, and the strength of nodes of the ferrocement ribbed slab with various beam columns (the node refers to a cross binding joint between a beam and a slab, a pole and a slab, or a beam and a pole, and is very important in the structure) is ensured. Moreover, the rebar of several spans of floor slabs (generally one room delimits one span, and floor slabs of several adjacent rooms are referred to as several spans of floor slabs) can be connected mutually to form a continuous two-way slab, thereby increasing the rigidity of the whole roof and improving the anti-seismic property thereof. Therefore, the ferrocement ribbed slab is more adaptable to various kinds of building floors, and may be applied more widely, saving a large quantity of building material for the country and reducing the damage to the environment.

The content which has not been described in detail in present invention generally belongs to the prior art known for those skilled in the art.

The invention claimed is:

1. A method of casting in-situ a ferrocement ribbed slab through a spliced rack and a suspended formwork, comprising steps of:

step 1) of prefabricating a transverse plane truss girder, an incomplete longitudinal plane truss girder and an incomplete longitudinal plane truss in a factory, wherein the transverse plane truss girder, the incomplete longitudinal plane truss girder and the incomplete longitudinal plane truss are configured to be spliced to make a mesh truss in constructing in-situ, and a width D and a height H of the mesh truss are selected according to span and load bearing requirements of a floor slab, fabricating the transverse plane truss girder with the height H, the incomplete longitudinal plane truss girder with the height H and the incomplete longitudinal plane truss with the height H by using an automatic truss welding machine, where the length of the transverse plane truss girder is equal to the width D;

step 2) of making a bottom formwork:

wherein the bottom formwork is made of light material with a good fire resistant and soundproof performance, and is reinforced for a large construction load by increasing the strength of the bottom formwork or adding a steel mesh within the bottom formwork considering requirements of the construction load;

step 3) of splicing and constructing a mesh truss on site:

wherein, the transverse plane truss girders are placed in position according to spacing requirements of the mesh truss and fixedly connected with a beam or a wall, thereby maintaining the transverse plane truss girder horizontal, subsequently the incomplete longitudinal plane truss girders are fixed on each of the transverse plane truss girders perpendicularly to the transverse plane truss girders and connected to the beam or wall, wherein the spacing between the adjacent incomplete longitudinal plane truss girders are conform to the spacing requirements of the mesh truss, then the incomplete longitudinal plane trusses are arranged below and spliced with the incomplete longitudinal plane truss girders, lastly, the transverse plane truss girder, the incomplete longitudinal plane truss girders and the incomplete longitudinal plane trusses are fixedly connected at intersections therebetween;

step 4) of suspending the bottom formworks:

wherein the bottom formworks are suspended and installed below the mesh truss through connectors, and a gap between the bottom formworks is filled, and the spacing between the bottom formworks meets the sectional requirement of the ferrocement ribbed slab;

step 5) of laying reinforcing mesh pieces:

wherein the reinforcing mesh pieces are laid on both sides of the floor slab and the rib according to structure requirements of the ferrocement ribbed slab, and then it is checked whether the structure requirements are met according to a blueprint;

step 6) of performing in-situ casting:

wherein self-levelling mortar, self-compacting mortar or self-compacting concrete is poured in-situ into the mesh truss enclosed by the bottom formwork and the reinforcing mesh, to integrally connect the reinforcing mesh, the bottom formwork and the mesh truss together, thereby finishing the in-situ construction of the in-situ cast ferrocement ribbed slab;

wherein the incomplete longitudinal plane truss girder comprises an upper horizontal rod for incomplete longitudinal plane truss girder and a plurality of web rods for incomplete longitudinal plane truss girder arranged below the upper horizontal rod for incomplete longitudinal plane truss girder, wherein every two web rods for incomplete longitudinal plane truss girder form a pair spliced into an inverted triangle structure, and the adjacent inverted triangle structures are spaced by a span of the inverted triangle structure.

2. The method of claim 1, wherein the transverse plane truss girder comprises an upper horizontal rod for transverse plane truss girder and a lower horizontal rod for transverse plane truss girder, a plurality of web rods for transverse plane truss girder are connected between the upper horizontal rod for transverse plane truss girder and the lower horizontal rod for transverse plane truss girder, so that every two web rods for transverse plane truss girder form a pair spliced into a triangular structure, wherein the adjacent triangular structures abut against each other.

3. The method of claim 2, wherein the incomplete longitudinal plane truss comprises a lower horizontal rod for incomplete longitudinal plane truss and a plurality of web rods for incomplete longitudinal plane truss arranged on the lower horizontal rod for incomplete longitudinal plane truss, wherein every two of the web rods for incomplete longitudinal plane truss web form a pair spliced into a triangle structure, and the adjacent triangle structures are spaced by a span of the triangle structure.

4. The method of claim 1, wherein the light material with a good fire resistant and sound proof performance which is used to make the bottom formwork is foam concrete.

5. The method of claim 1, wherein the connector used in step 4) is embedded in advance within the bottom formwork.

6. A method of casting in-situ a ferrocement ribbed slab through a spliced rack and a suspended formwork, comprising steps of:

step 1) of prefabricating a transverse plane truss girder, an incomplete longitudinal plane truss girder and an incomplete longitudinal plane truss in a factory, wherein the transverse plane truss girder, the incomplete longitudinal plane truss girder and the incomplete longitudinal plane truss are configured to be spliced to make a mesh truss in constructing in-situ, and a width D and a height H of the mesh truss are selected according to span and load bearing requirements of a floor slab, fabricating the transverse plane truss girder with the height H, the incomplete longitudinal plane truss girder with the height H and the incomplete longitudinal plane truss with the height H by using an automatic truss welding machine, where the length of the transverse plane truss girder is equal to the width D;

step 2) of making a bottom formwork:

wherein the bottom formwork is made of light material with a good fire resistant and soundproof performance, and is reinforced for a large construction load by increasing the strength of the bottom formwork or adding a steel mesh within the bottom formwork considering requirements of the construction load;

step 3) of splicing and constructing a mesh truss on site:

wherein, the transverse plane truss girders are placed in position according to spacing requirements of the mesh truss and fixedly connected with a beam or a wall, thereby maintaining the transverse plane truss girder horizontal, subsequently the incomplete longitudinal plane truss girders are fixed on each of the transverse plane truss girders perpendicularly to the transverse plane truss girders and connected to the beam or wall, wherein the spacing between the adjacent incomplete longitudinal plane truss girders are conform to the spacing requirements of the mesh truss, then the incomplete longitudinal plane trusses are arranged below and spliced with the incomplete longitudinal plane truss girders, lastly, the transverse plane truss girder, the incomplete longitudinal plane truss girders and the incomplete longitudinal plane trusses are fixedly connected at intersections therebetween;

step 4) of suspending the bottom formworks:

wherein the bottom formworks are suspended and installed below the mesh truss through connectors, and a gap between the bottom formworks is filled, and the spacing between the bottom formworks meets the sectional requirement of the ferrocement ribbed slab;

step 5) of laying reinforcing mesh pieces:

wherein the reinforcing mesh pieces are laid on both sides of the floor slab and the rib according to structure requirements of the ferrocement ribbed slab, and then it is checked whether the structure requirements are met according to a blueprint;

step 6) of performing in-situ casting:

wherein self-levelling mortar, self-compacting mortar or self-compacting concrete is poured in-situ into the mesh truss enclosed by the bottom formwork and the reinforcing mesh, to integrally connect the reinforcing mesh, the bottom formwork and the mesh truss together, thereby finishing the in-situ construction of the in-situ cast ferrocement ribbed slab;

wherein the incomplete longitudinal plane truss comprises a lower horizontal rod for incomplete longitudinal plane truss and a plurality of web rods for incomplete longitudinal plane truss arranged on the lower horizontal rod for incomplete longitudinal plane truss, wherein every two of the web rods for incomplete longitudinal plane truss web form a pair spliced into a triangle structure, and the adjacent triangle structures are spaced by a span of the triangle structure.

7. The method of claim 6, wherein the transverse plane truss girder comprises an upper horizontal rod for transverse plane truss girder and a lower horizontal rod for transverse plane truss girder, a plurality of web rods for transverse plane truss girder are connected between the upper horizontal rod for transverse plane truss girder and the lower horizontal rod for transverse plane truss girder, so that every two web rods for transverse plane truss girder form a pair spliced into a triangular structure, wherein the adjacent triangular structures abut against each other.

8. The method of claim 6, where the incomplete longitudinal plane truss girder comprises an upper horizontal rod for incomplete longitudinal plane truss girder and a plurality of web rods for incomplete longitudinal plane truss girder arranged below the upper horizontal rod for incomplete longitudinal plane truss girder, wherein every two web rods for incomplete longitudinal plane truss girder form a pair spliced into an inverted triangle structure, and the adjacent inverted triangle structures are spaced by a span of the inverted triangle structure.

9. The method of claim 6, wherein the light material with a good fire resistant and sound proof performance which is used to make the bottom formwork is foam concrete.

10. The method of claim 6, wherein the connector used in step 4) is embedded in advance within the bottom formwork.

* * * * *